United States Patent [19]

Ranten

[11] 4,342,073

[45] Jul. 27, 1982

[54] CEILING FAN WITH ILLUMINATION MEANS

[75] Inventor: Richard Ranten, Mitcham, Australia

[73] Assignee: Mistral Incorporated, Anaheim, Calif.

[21] Appl. No.: 152,487

[22] Filed: May 22, 1980

[51] Int. Cl.[3] ..... F21V 29/00

[52] U.S. Cl. ..... 362/294; 362/96; 362/147; 362/404; 362/806

[58] Field of Search ..... 362/96, 299, 147, 404, 362/806

[56] References Cited

U.S. PATENT DOCUMENTS

| | | | |
|---|---|---|---|
| D. 82,179 | 9/1930 | Ringwald | 362/294 |
| 332,821 | 12/1885 | Murray, Jr. | 362/294 |
| 585,250 | 6/1897 | Bennett, Jr. | 362/294 |
| 623,801 | 4/1899 | Melzer | 362/294 |
| 636,871 | 11/1899 | Wait | 362/294 |
| 905,089 | 11/1908 | McBerty | 362/294 |
| 1,222,837 | 4/1917 | Winslow et al. | 362/294 |
| 1,445,402 | 2/1923 | Le Velle | 362/294 |
| 1,699,201 | 1/1929 | Both | 362/294 |
| 2,119,398 | 5/1938 | Morse | 362/294 |
| 2,201,153 | 5/1940 | Brown | 362/96 |
| 2,547,896 | 4/1951 | Wellen | 362/294 |
| 2,581,185 | 1/1952 | Gordon | 362/294 |
| 3,294,977 | 12/1966 | Duncan | 362/294 |
| 4,064,427 | 12/1977 | Hansen et al. | 362/96 |
| 4,073,598 | 2/1978 | Mizutani et al. | 362/294 |

FOREIGN PATENT DOCUMENTS

| | | | |
|---|---|---|---|
| 134971 | 11/1919 | United Kingdom | 362/294 |
| 235200 | 7/1925 | United Kingdom | 362/294 |
| 608569 | 9/1948 | United Kingdom | 362/294 |

*Primary Examiner*—Stephen J. Lechert, Jr.

*Attorney, Agent, or Firm*—Fitch, Even, Tabin, Flannery & Welsh

[57] ABSTRACT

A ceiling sweep fan includes a motor depending from a ceiling mount, the motor being supported for rotation on a vertical axis, a plurality of radially extending air impeller blades supported for rotation by the motor, means for providing illumination mounted in radial alignment with the motor, and a shallow bowl-shaped light transmission member covers the motor and the illumination means.

12 Claims, 6 Drawing Figures

CEILING FAN WITH ILLUMINATION MEANS

This invention generally relates to a ceiling fan and more particularly to a depending type electric ceiling fan having in combination an electric illuminating means.

The conventional ceiling fan has been known and used for many years to circulate air. Such ceiling fans typically employ a depending motor having radially extending blades connected to the rotary part of the motor for rotation on a vertical axis. Many such fans date back to at least the 1890's. During more recent years, use of ceiling fans substantially declined, but a resurgence of interest has been evidenced, and the ceiling fan is again popular. Various models of the ceiling fan carry forth the old-time styling even though more modern materials may be used in their manufacture.

Ceilings are much lower, however, in today's building construction, and ceiling fans used in areas having relatively low ceilings could present hazards. Hence, the floor to fixture clearance is important.

It also has been known to combine various forms of light fixtures with ceiling fans and using the combination device as a replacement for an existing light fixture in a room to utilize the wiring already available for electrical power at a ceiling fixture mounting. A conventional construction of such a ceiling fan-light combination includes a center lamp encased by a globe located underneath the fan motor and/or fan hub. In such a device, the total length of the depending stem, the axial dimension of the motor, and the diameter of the globe may leave inadequate clearance from floor to fixture insofar as personnel safety is concerned.

It is therefore an object of this invention to provide a ceiling fan with illumination means especially useful in situations of a relatively low ceiling where it is desirable to maximize floor-to-fixture clearance.

It is a further object of this invention to provide a ceiling fan with illumination means wherein the motor and illumination means combination has a relatively large horizontal dimension to vertical dimension ratio.

Other objects of the invention will become apparent and the invention readily understood from the following description read in conjunction with the accompanying drawings in which:

FIG. 4 is a side sectional view taken primarily along a vertical plane which includes the line 4—4 of FIG. 1;

Briefly, FIGS. 1–4 show a ceiling fan depending from a means for mounting on an overhead surface. A motor is supported for rotation on a vertical axis, and a rotating portion of the motor carries two or more radially extending air impeller blades for moving air axially when the blades are rotated. Provision is made for a support means mounted on the vertical axis to carry an illumination means surrounding and on the same horizontal level as the motor. Light transmission means in the form of a shallow horizontally extended bowl covers both the illumination means and the motor.

This structure has a principal advantage of combining a ceiling fan and an illumination means in such a manner that both are provided in one fixture without reducing clearance height from the floor to the fixture.

Figure 1:
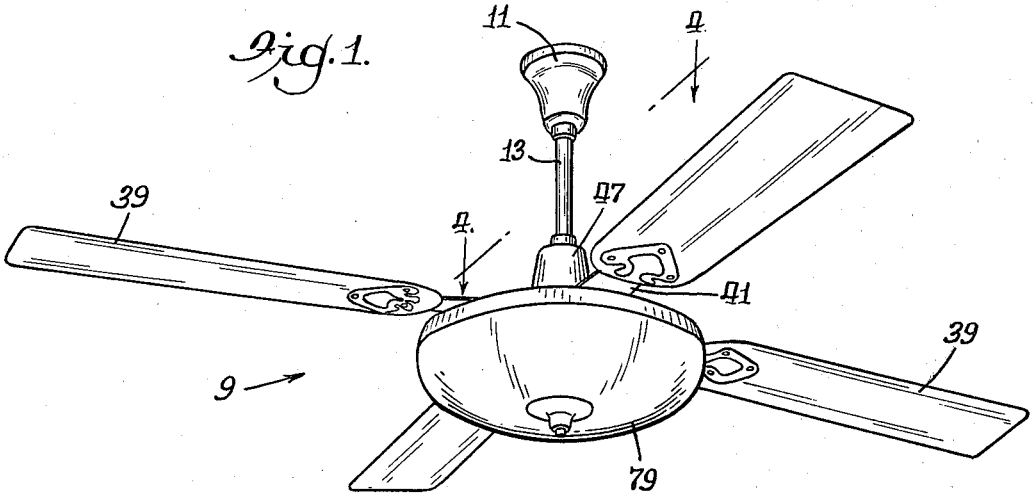
FIG. 1 is a perspective view of a ceiling fan with illumination means constructed in accordance with the principles of this invention.

More particularly, and referring first to FIG. 1, there is shown a ceiling fan with illumination means 9 having a mounting cover 11 and a depending tubular hanger or stem 13. Although not shown in the drawing, the mounting may be of the conventional fixture type for attachment to an electrical box in the ceiling that both provides wiring for the electrical power and physical support for the fixture. As to the wiring, it will be seen in FIG. 4 that two separate circuits are contemplated, one represented by the double line 15 for the motor, and the other by the dashed line 17 for the illumination means. The stem 13 may be conventional tubular stock as used in light fixtures and ceiling fans for supporting the depending combination fan and illumination means.

Referring now to FIG. 4, the basic fan includes a motor generally referred to as 19, portions of which are mounted for rotation about the vertical axis. The motor includes a stator 21 supported in its center on a vertical shaft 23 that is stationary and passes axially through the stator 21. A rotor 25 encircles the stator 21 and is radially spaced outwardly therefrom by the distance of a gap 27. The rotor is mounted concentrically with respect to the stator 21 for rotation around the stator. A rotor housing 29 includes a top 31, a bottom 33 and side supports 35. The housing is mounted for rotation on the shaft 23 by suitable means, such as ball bearings 37. The ball bearings are spaced axially above and below the stator 21, and the entire housing rotates around this vertical shaft. The rotor 25 is affixed in a suitable manner to the rotatable housing 29 so that as the rotor is caused to rotate when the motor 19 is energized, the housing will be carried in rotation by the rotor.

The principle purpose of the rotor housing 29 is to provide support for the axially extending air impeller blades. In the illustrated embodiment, there are four air impeller or fan blades 39 shown. Each fan blade 39 is connected to the rotatable housing 29 by a bracket 41. Each fan blade 39 is long and narrow, i.e., the longitudinal dimension of the fan blade is substantially greater than the transverse dimension of the blade. Each blade is pitched with respect to the plane of rotation so as to cause axial movement of the air with respect to the fixture. The blades may be made of any suitable material, such as metal, plastic, wood, or any combination thereof. The four blades shown in the illustrated embodiment are shown for purposes of illustration only, there being no intention of restricting the invention to fans having a specific number of blades. Of course, dynamic balance of the rotating blades is necessary for proper operation of the motor, and therefore at least two blades would be utilized. Whatever number of blades the plurality includes, the blades are disposed in such a manner around the hub to extend radially outwardly with equal angles separating adjacent blades. Ceiling fans are conventionally provided with fan diameters ranging from 36 inches to 54 inches. The mentioned diameter is that of the circumference formed by the outermost tips of the blades as the blades rotate. This range is illustrative only, however, for there is no intention to confine this invention for use in ceiling fans of any particular diameter or range of diameters.

It will be noted that the motor 19 has the appearance of a "pancake," that is, the radial or horizontal dimension substantially exceeds the axial or vertical dimension. For example, the ratio of the radial direction to the axial direction may exceed 3 to 1. A conventional single phase induction motor having the stator member on the inside and the rotor on the outside may be utilized in this embodiment. Preferably, the motor should be a continuous-duty, permanent split-capacitor motor having a horse power adequate for the fan load. The fan load, of course, is a result of the diameter of the blade, the pitch of the blade, and the speed of rotation, all of which are determined in accordance with standard engineering principles for the desired amount of air to be moved by the fan.

A capacitor 43 may be axially spaced on either side of the motor, but preferably it is carried above the motor 19 by a yoke 45. The yoke is connected at its lower end to the shaft 23 and at its upper end to the tubular hanger 13. A bell-shaped cap 47 covers the yoke. The wiring indicated at 15 and 17 is only illustrative of the bundles of wires used in each instance for the fixture wiring of the motor 19 and the illumination means (to be discussed hereinafter), it being understood that it is not intended to show the actual wiring. The wiring is in accordance with general electrical engineering principles and to simplify this disclosure, the actual wiring, or even schematic wiring, of the circuits is not shown or described.

In accordance with this invention, an illumination means 49 is disposed in surrounding coaxial relation with respect to the pancake motor 19 on the same general radial or horizontal level as the motor 19. This disposition is provided by a support or mounting means 51 which is suitably supported on the vertical axis along with the motor 19.

Figure 2:
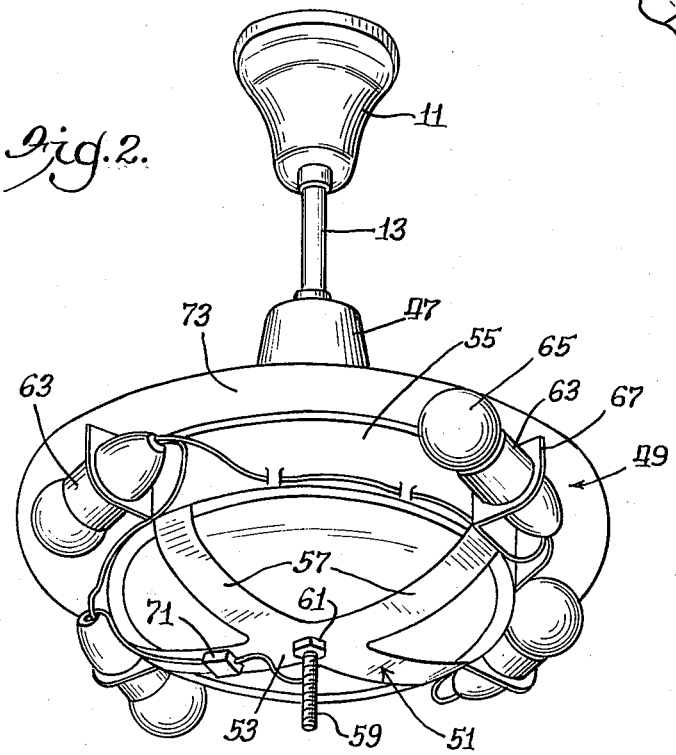
FIG. 2 is a perspective view of the device of FIG. 1 with certain portions exposed and illustrating one form of illumination means.
Figure 1:
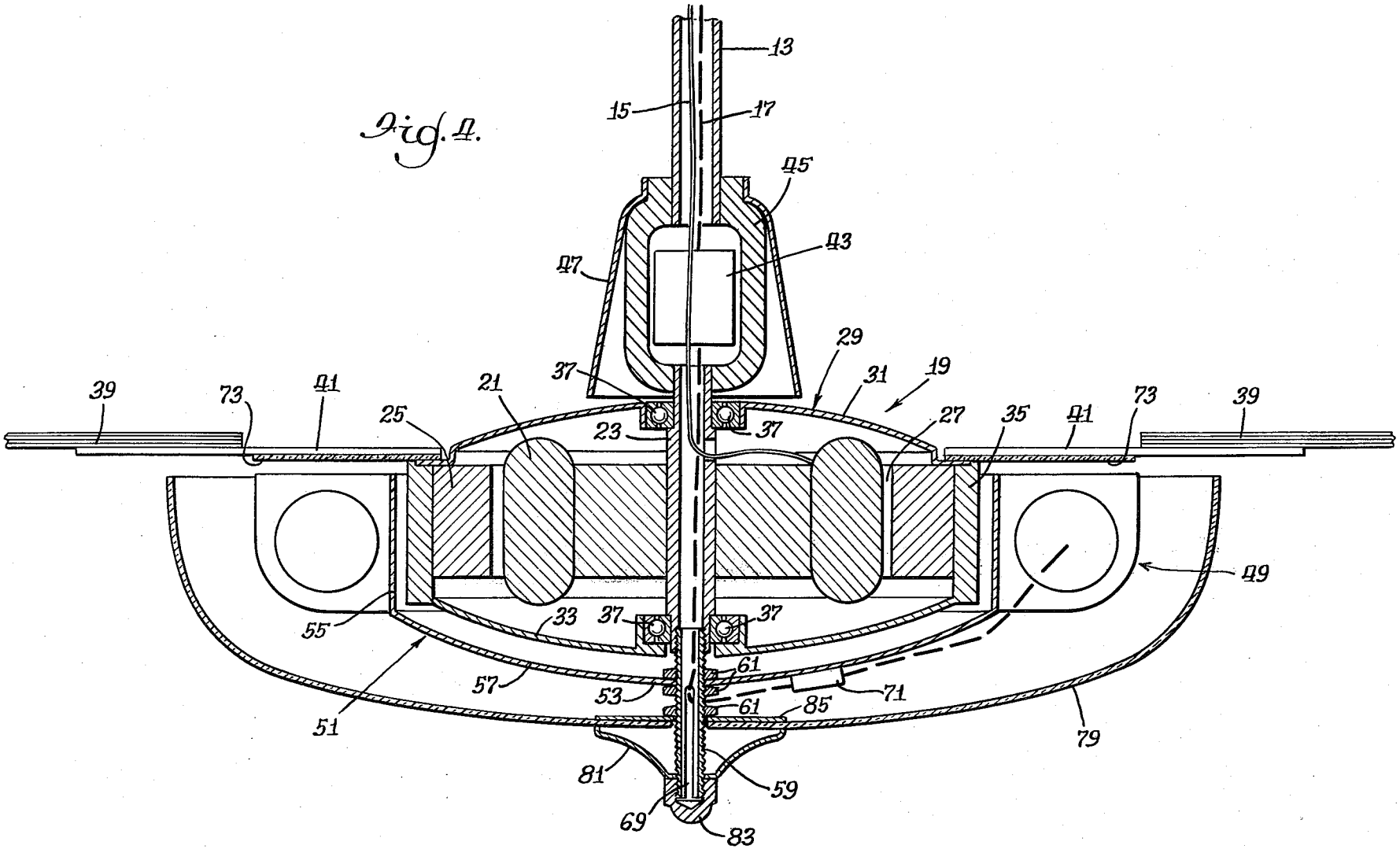

More specifically, and referring to FIG. 2, the illustrated mounting means 51 includes a support frame having a hub 53, a cylindrical support member 55, and a plurality of arms 57 joining the hub and the support member. The hub 53 is provided with a clearance hole adequate to receive the shaft 23. In the illustrated embodiment as seen in FIG. 4, the particular illustrated shaft 23 extends only through the center of the motor 19 and a short distance axially on either side of the motor to the bearings 37. Extending the length of the shaft below the motor is a threaded extension 59, which effectively extends the shaft 23 along the vertical axis for mounting additional parts below the motor 19. Of course, the shaft 23 and the threaded extension 59 could be integral or one piece. A pair of nuts 61 are disposed on either side of the hub 53 and are threaded onto the extension 59 of the shaft 23 toward each other with the hub between them as a means of supporting the mounting means 51. In the illustrated embodiment, four arms 57 in the form of flat straps extend between the hub 53 and the cylindrical member 55 to form a unified support frame. The straps are curved as indicated in FIG. 4 to generally follow the contour of the bottom 33 of the housing, though spaced apart therefrom. The arms are formed either integrally with the hub 53 and the cylindrical support member 55 or are attached in a suitable manner to these parts to provide the unified frame. The cylindrical support member 55, of course, has its body or wall extending vertically in a radially spaced disposition outwardly of the side support 35 of the rotor housing 29. This cylindrical member 55 serves as the immediate supporting surface for the illumination means 49.

The illumination means shown in FIG. 2 is in the form of incandescent lamps. On the cylindrical support member 55 are mounted a plurality of candelabra type sockets 63, each of which receive an incandescent lamp 65. This combination is supported in a plate 67 which is affixed in a suitable manner to the cylindrical support member 55. Although four lamps and holders are indicated in the illustrated embodiment of FIG. 2, there is no intention to restrict this invention to a specific number of lamps and lamp holders. The lamps are wired as indicated in FIG. 4 by the wiring group 17 which extends downwardly through the stem 13, through the yoke 45, into the shaft 23 and thence to the extension 59. The threaded extension 59 is provided with a slot 60 as an outlet for the wiring. The wiring then extends to a connection block 71 from which further wiring connects the lamps in parallel around the fixture.

As indicated previously, the fan includes a plurality of air impeller blades 39 which by means of brackets 41 are connected to the rotor housing 29 for support and rotation. In the illustrated embodiment, these blades are connected to the overhead portion of the rotor housing 29 and, hence, the brackets and blades pass overhead of the illumination means 49. In general, ceiling fans rotate at a low rate of speed compared to other air circulating devices. As this assembly rotates overhead of the illumination means, the brackets and blades are in a position to periodically intersect vertically extending light rays and cause distracting shadows or fluttering on the ceiling. A shade 73 in the form of a flat ring is provided on the peripheral edge of the rotor housing between the illumination means 49 and the blades 39 and brackets 41 to prevent such flutter, however. The ring rotates with the housing and continuously interrupts the vertical light rays directed from the source to the ceiling.

It will be noted in FIG. 4 that the unified frame 51 mounts the illumination means 49 in such a manner with respect to the motor 19 that substantially only the horizontal dimension is increased by the addition of the illumination means to the fan. The vertical dimension below the motor is only slightly increased by the thickness of the nuts 61 and the small space between the arms 57 and the bottom 33.

Figure 3:
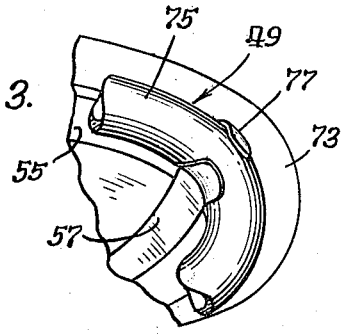
FIG. 3 is a view similar to FIG. 2 except illustrating another form of illumination means.

The illumination means 49 could also be in a form other than the incandescent lamps 65 shown in FIG. 2. Another such illumination means, for example, is a fluorescent tube 75 mounted on the cylindrical support member 55 as shown in FIG. 3. The structure of the embodiment shown in FIG. 3 is otherwise the same as that shown in FIG. 2. A C-shaped holder 77 mounts the fluorescent tube to the cylindrical member 55 in place of the mounting plate 67 (FIG. 2).

To enclose the lower end of the fixture, a light transmission member 79 in the form of an annular cover is mounted under the motor. This light transmission member is preferably of a translucent material which will diffuse the light passing through it so that objects within the enclosure are indistinguishable. Such a member covers the motor and illuminating means while allowing light to pass through. As may be seen in FIG. 4, the light transmission member 79 may be in the form of a shallow bowl, whereby the diameter of the bowl is substantially greater than the depth. For example, the ratio of diameter to depth may be greater than 4 to 1.

The light transmission member 79 is mounted on the shaft 23, or its threaded extension 59, by means of a bezel 81 held in place by a dome nut 83. The dome nut caps the end of the threaded shaft and applies upward pressure to the bezel which in turn presses against the light transmission member 79. To provide a means of distributing pressure, a disc 85 is inserted on the inside between the light transmission member and another lock nut 61 as shown. The opening of the bowl is, of course, directed upwardly, and the direction of the side walls at the rim is substantially vertical in the illustrated embodiment. The walls, however, could continue the curve back in toward the illumination means 49 to terminate in spaced apart relation with respect to the shade 73 instead of terminating vertically.

Figure 5:
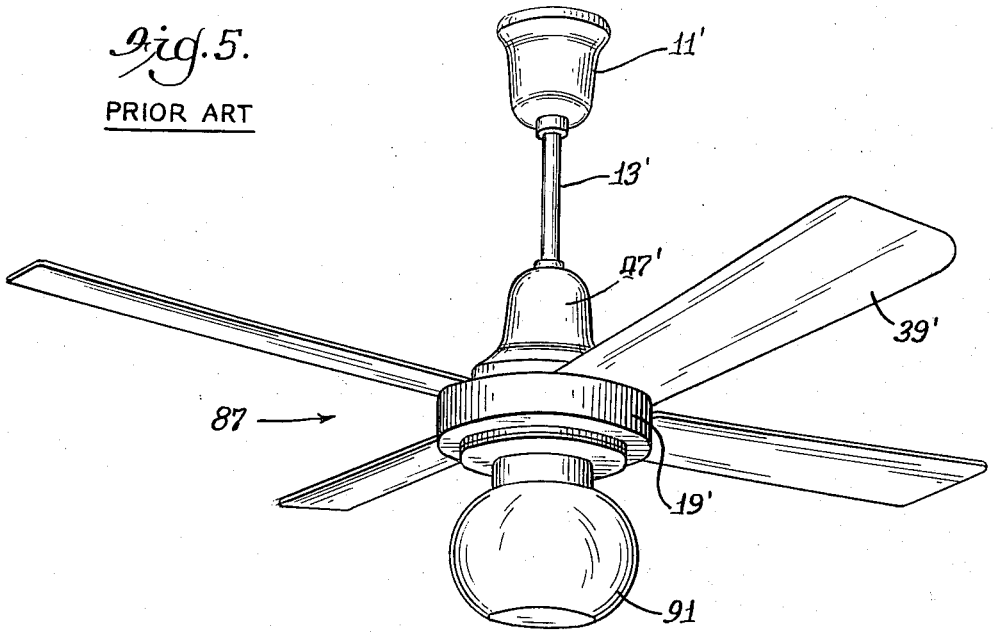
Fig. 5. PRIOR ART
FIG. 5 is one form of a prior art device.
Figure 6:
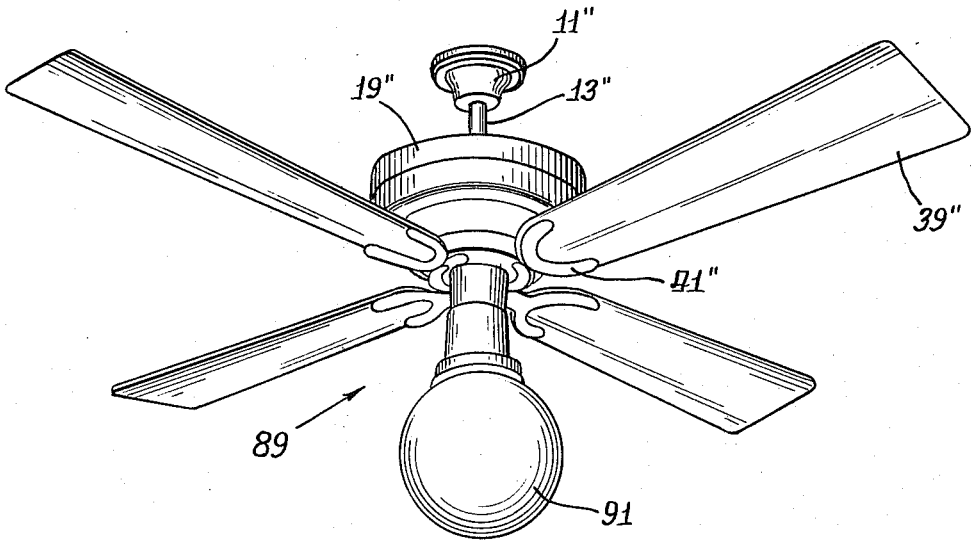
Fig. 6. PRIOR ART
FIG. 6 is another form of a prior art device.

The advantage of this described structure of the ceiling fan with illumination means 9 will become readily apparent upon a comparison with prior art devices 87 and 89 shown in FIGS. 5 and 6 respectively. Reference numbers for parts having the same function as the device in FIG. 1, have the same reference number with a prime (') added in the device 87 and with double prime (") in the device 89.

The device 87 includes a ceiling fan having provision for mounting to the ceiling, which provision includes a mounting cover 11'. The fan depends from the ceiling by a tubular hanger or stem 13' which supports a pancake type motor 19'. A plurality of air impeller or fan blades 39' are connected to the motor for rotation overhead of the motor under a cap 47'. A light globe 91 completely subtends the motor 19', and although adding the convenience of a light to the fan, this combination is substantially longer than the fan alone, because the globe 91, no matter what its dimension, is in its entirety added to the vertical length of the fan. Such combination structure, of course, diminishes the floor-to-fixture clearance over that of the fan structure alone.

The device 89 shown in FIG. 6 is similar to the device 87, except that the fan blades 39" are attached by means of brackets 41" that connect them to the rotating motor 19" in a plane that is underneath the motor. The light globe 91 subtends this arrangement and also adds to the vertical length of the fan. Hence, the combination is considerably longer than the fan alone, allowing less floor-to-fixture clearance.

It will be seen from the foregoing description that an advantageous structure combining a ceiling fan with illumination means has been provided wherein the illumination means has been added to a ceiling fan without diminishing to any appreciable extent the floor-to-fixture clearance height. Thus, in accordance with this invention, there has been provided a ceiling fan with illumination means including a motor to be supported from a ceiling, the motor having a central stator and a rotor disposed radially outwardly of the stator, the dimension of the motor in the radial direction being substantially greater than the dimension in the axial direction, a shaft extending axially through the center of the stator in the vertical direction in providing support for the stator, a rotor housing mounted for rotation on the shaft at locations of the shaft spaced axially above and below the stator, the housing being attached to the rotor and being rotated thereby, a plurality of axial flow impeller blades mounted on and extending radially outwardly from the housing, each blade having its longitudinal dimension substantially greater than its transverse dimension, stationary illumination means, and means for mounting the stationary illumination means in radial alignment with the motor and spaced radially outwardly of the motor housing.

While the invention has been described in connection with a preferred embodiment, alternatives, modifications and variations may be apparent to those skilled in the art in view of the foregoing description. Accordingly, it is intended to embrace all such alternatives, modifications and variations as fall within the spirit and scope of the appended claims.

What is claimed is:

1. A ceiling fan with illumination means comprising:

a motor to be supported from a ceiling, said motor having a central stator and a rotor disposed radially outwardly of the stator, the dimension of said motor in the radial direction being substantially greater than the dimension thereof in the axial direction;

a stationary shaft extending coaxially through the stator in the vertical direction and providing support for said stator;

a rotor housing mounted for rotation on said shaft at locations thereon spaced axially above and below said stator, said housing being attached to said rotor for rotation thereby on the vertical axis;

a plurality of axial flow blades mounted on and extending radially outwardly from said housing, each blade having its longitudinal dimension substantially greater than its transverse dimension;

stationary illumination means; and means mounting said stationary illumination means in radial alignment with said motor and spaced radially outwardly of and adjacent said rotor housing.

2. A fan in accordance with claim 1 wherein said blades extend overhead of said illumination means and further including a shade intermediate said illumination means and said blades preventing the blades from intersecting upwardly directed light rays from said illumination means.

3. A fan in accordance with claim 1 wherein said rotor housing is mounted for rotation on said shaft by means of ball bearings both above and below the stator.

4. A fan in accordance with claim 1 wherein said illumination means includes a plurality of incandescent lamps and wherein said mounting means includes provision for supporting a plurality of holders in circumferentially spaced relation around the outside of said rotor housing for containing the incandescent lamps.

5. A fan in accordance with claim 1 wherein said illumination means is a fluorescent tube.

6. A fan in accordance with claim 1 wherein said motor is a permanent split-capacitor type single phase motor and further including a capacitor mounted in a yoke connected to said shaft and located in axially spaced relation to said rotor housing.

7. A fan in accordance with claim 6 wherein said capacitor is located above said motor.

8. A fan in accordance with claim 1 wherein said mounting means includes a support frame having a hub mounting said frame on said shaft in axially spaced relation to said rotor housing, a cylindrical support member located in coaxial relation to said motor and spaced radially outwardly of said rotor housing, and a plurality of arms joining said hub and said cylindrical member, said illumination means being mounted on said support member.

9. A fan in accordance with claim 8 further including a threaded portion of said shaft extending below said motor and a pair of nuts threaded on said portion on either side of said hub mounting said frame.

10. A fan in accordance with claim 9 further including a light transmission member in the form of an annular cover mounted on the underside of said motor on said threaded shaft portion, the diameter of the cover being substantially greater than its depth.

11. In combination with a ceiling fan having illumination means and having a motor depending in spaced relation below a ceiling when said fan is mounted thereon and a plurality of axial flow fan blades extending radially outwardly from said motor and being supported for rotation thereby, each said blade having a longitudinal dimension that is substantially greater than the transverse dimension;

a motor whose horizontal dimension substantially exceeds its vertical dimension, said motor having a centrally mounted stator supported on a vertical axis and a concentrically mounted rotor in outwardly spaced radial relation with the stator, a housing mounted for rotation on the vertical axis coaxially with respect to the stator, said housing being connected to the rotor and being rotated thereby, illumination means mounted in horizontal alignment with said motor and in outwardly spaced but adjacent radial relation thereto, and light transmission means covering said motor and said illumination means and mounted on the underside of the motor, said light transmission means being in the form of a bowl whose diameter substantially exceeds its depth.

12. A combination in accordance with claim 11 wherein the ratio of diameter to depth of said light transmission means is at least 4 to 1.

* * * * *